US008010001B2

(12) United States Patent
Donaldson

(10) Patent No.: US 8,010,001 B2
(45) Date of Patent: Aug. 30, 2011

(54) SPECULAR DIFFUSE BALANCE CORRECTION METHOD

(75) Inventor: Patricia Joanne Donaldson, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 735 days.

(21) Appl. No.: 11/944,243

(22) Filed: Nov. 21, 2007

(65) Prior Publication Data

US 2009/0129801 A1 May 21, 2009

(51) Int. Cl.
*G03G 15/00* (2006.01)

(52) U.S. Cl. ..... 399/49; 399/72

(58) Field of Classification Search ..... 399/49, 399/72, 74; 250/341.8
See application file for complete search history.

(56) References Cited

U.S. PATENT DOCUMENTS 4,951,088 A 8/1990 Bonvallet et al.
5,162,874 A 11/1992 Butler
5,777,656 A * 7/1998 Henderson ..... 347/251
6,462,821 B1 10/2002 Borton et al.
2004/0253012 A1* 12/2004 Ishibashi ..... 399/49
2006/0024077 A1* 2/2006 Scheuer et al. ..... 399/74
2006/0153580 A1 7/2006 Mo et al.

* cited by examiner

*Primary Examiner* — David Gray
*Assistant Examiner* — Billy J Lactaoen
(74) *Attorney, Agent, or Firm* — Pillsbury Winthrop Shaw Pittman LLP

(57) ABSTRACT

According to the invention, a method is provided for calculating a Fractional Area Coverage (FAC) for determining the density of toner to evaluate the effectiveness of a xerographic printing process. The amount of diffuse light being reflected at the specular angle is determined during densitometer calibration and subsequent specular sensor readings are corrected by subtracting a fraction of the diffuse sensor signal from the specular sensor signal. Also provided is a computer readable media having stored computer executable instructions, wherein the computer executable instructions, when executed by a computer, directs a computer to perform a method for calculating a FAC for determining the density of toner to evaluate the effectiveness of a xerographic printing process.

28 Claims, 11 Drawing Sheets

SPECULAR DIFFUSE BALANCE CORRECTION METHOD

FIELD

A method for calculating a Fractional Area Coverage (FAC) for determining the density of toner to evaluate the effectiveness of a xerographic printing process is provided. In particular, the amount of diffuse light being reflected at the specular angle is determined during densitometer calibration and subsequent specular sensor readings are corrected by subtracting a fraction of the diffuse sensor signal from the specular sensor signal.

BACKGROUND

In xerographic print engines, a tone reproduction curve (TRC) is important in controlling the image quality of the output. An image input to be copied or printed has a specific tone reproduction curve. The image output terminal outputting a desired image has an intrinsic tone reproduction curve. If the image output terminal is allowed to operate uncontrolled, the tone reproduction curve of the image output by the image output terminal will distort the rendition of the image. Thus, an image output terminal should be controlled to match its intrinsic tone reproduction curve to the tone reproduction curve of the image input. An intrinsic tone reproduction curve of an image output terminal may vary due to changes in such uncontrollable variables such as humidity or temperature and the age of the xerographic materials, i.e., the numbers of prints made since the developer, the photoreceptor, etc. were new.

Solid developed mass per unit area (DMA) control is a critical part of TRC control. If the DMA is too low then the images will be too light and customers will be dissatisfied. On the other hand, if the DMA is too high, then other xerographic or image quality problems, such as poor transfer efficiency, fusing defects, or toner scatter on lines, etc., can occur. High DMA will also increase the total cost to owner. Maintaining a constant DMA or a low variation of DMA has always been a challenge in xerographic process controls design.

In addition, in copying or printing systems, such as a xerographic copier, laser printer, or ink-jet printer, a common technique for monitoring the quality of prints is to artificially create a "test patch" of a predetermined desired density. The actual density of the printing material (toner or ink) in the test patch can then be optically measured by a suitable sensor to determine the effectiveness of the printing process in placing this printing material on the print sheet. In such a case, the optical device for determining the density of toner on the test patch, which is often referred to as a "densitometer," is disposed along the path of the photoreceptor, directly downstream of the development unit. For example, see U.S. Pat. No. 5,162,874, herein incorporated by reference.

In the case of xerographic devices, such as a laser printer, the surface that is typically of most interest in determining the density of printing material thereon is the charge-retentive surface or photoreceptor, on which the electrostatic latent image is formed and subsequently developed by causing toner particles to adhere to areas thereof that are charged in a particular way. There is typically a routine within the operating system of the printer to periodically create test patches of a desired density at predetermined locations on the photoreceptor by deliberately causing the exposure system thereof to charge or discharge as necessary the surface at the location to a predetermined extent. Test patches are used to measure the deposition of toner on paper to measure and control the tone reproduction curve.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested; the more light that is absorbed by the test patch, the denser the toner on the test patch. The sensor readings are then used to make suitable adjustments to the system such as changing developer bias to maintain consistent quality.

Typically each patch is about an inch square that is printed as a uniform solid half tone or background area. This practice enables the sensor to read one value on the tone reproduction curve for each test patch.

The Xerox iGen3® digital printing press includes a densitometer, for example, an Enhanced Tone Area Coverage (ETAC) sensor, as disclosed in U.S. Pat. No. 6,462,821, and herein incorporated by reference. As shown in FIG. 1A, the ETAC sensor contains an illuminator, e.g., a single light emitting diode (LED) 2, and two sensors, a diffuse sensor $\mathbf{3}_{diff}$ and a specular sensor $\mathbf{3}_{spec}$. When the ETAC is located at the optimal distance d from the photoreceptor 1 the LED 2 is at a 45° angle with respect to diffuse sensor $\mathbf{3}_{diff}$ and at a 90° angle with respect to specular sensor $\mathbf{3}_{spec}$.

A processor (not shown) is provided to both calibrate the sensors and to process the reflectance data detected by the sensors. It may be dedicated hardware like ASICs or FPGAs, software, or a combination of dedicated hardware and software. For the different applications the basic algorithm for extracting the specular and diffuse components would be the same but the analysis for the particular applications may vary.

While specular light is reflected only at 90°, diffuse light is reflected over a wide range of angles, including the specular angle. The specular reflection, which is sensitive to the area covered by the toner is used to control the Tone Reproduction Curve (TRC), and hence the colors printed by the printing press. Unfortunately, some of the diffuse light reflected from the toner will be reflected at the specular angle. The amount of diffuse reflection depends on manufacturing parameters and on the particular spacing between the sensor and photoreceptor. While varying the ETAC spacing is not a desirable feature, it is nonetheless an unavoidable outcome of manufacturing tolerances. This variation is a contributor to machine-to-machine color variation in the field.

During operation of the printing press, the toner will absorb and scatter a portion of the light from LED 2, such that some of the light is not reflected at the specular angle. Black toner absorbs more light at the LED 2 wavelength, and scatters minimally. On the other hand, however, colored toner does not absorb all of the light, and scatters a substantial amount of it, so that it is widely spread over a range of angles.

The densitometer may be calibrated by determining an uncompensated specular sensor value, i.e., the specular light component of the total light collected from a central (specular) sensor. When the ETAC sensor is manufactured and/or subsequently calibrated, the light detected by diffuse sensor is internally subtracted from the specular sensor signal. Moreover, in order to compensate for environmental conditions and differences between individual machines, only a fraction of the diffuse signal may be internally subtracted, corresponding to a compensation ratio of the voltages of the specular and sensor signals.

Since the amount of diffuse light reflected at the specular angle is generally small, the residual error in the specular sensor signal, i.e., the amount of diffuse light actually incident on the specular sensor $\mathbf{3}_{spec}$, is usually assumed to be negligible. For example, FIG. 2 depicts a plot of Vspec and Vdiff, and the sum of Vspec and Vdiff. Since the value of Vspec plus Vdiff is substantially the same as Vspec, the residual error in the specular sensor signal has generally been ignored.

In operation of the printing press, the area covered by toner is determined by dividing the amount of light absorbed by the toner from the total amount of light reflected from the photoreceptor. This is referred to as the Fractional Area Coverage (FAC). The measured Fractional Area Coverage (mFAC) is calculated based on the specular voltage, according to Equation 1:

$$\text{mFAC}=(Vcb-Vspec)/(Vcb-V01x) \quad (1)$$

where: Vcb is the voltage returned from the specular sensor $\mathbf{3}_{spec}$ from a clean photoreceptor (i.e., one having no toner on it);

V01x is the background noise signal returned from the specular sensor $\mathbf{3}_{spec}$ with the LED 2 turned off. For example, the specular sensor $\mathbf{3}_{spec}$ generally returns a signal of approximately +0.5 V in the absence of any light; and Vspec is the specular voltage returned from the patch being measured less the value internally subtracted by the ETAC sensor.

Unfortunately, the impact of a diffuse balance error is magnified due to variance in the spacing of the ETAC sensor from the photoreceptor 1. As shown in FIG. 1B, as the distance d' between the sensors $\mathbf{3}_{spec}$, $\mathbf{3}_{diff}$ and the photoreceptor 1 varies due to manufacturing tolerances, the LED 2 is no longer at a 45° angle with respect to diffuse sensor $\mathbf{3}_{diff}$ and at a 90° angle with respect to specular sensor $\mathbf{3}_{spec}$. This may increase the angle of the specular sensor $\mathbf{3}_{spec}$ such that it becomes closer to the diffuse angle, and more diffuse light is gathered by the specular sensor $\mathbf{3}_{spec}$. FIG. 3 shows a plot of the angles of the specular and diffuse sensors with respect to the spacing of the ETAC sensor. In addition, as the specular angle moves off a right-angle (90°) from the LED 2 intensity must be increased to give the same specular signal, which also increases the total diffuse light output.

FIG. 4 shows a plot of a DMA sweep and how these problems are manifested. For example, if the ETAC sensors $\mathbf{3}_{spec}$, $\mathbf{3}_{diff}$ are too close to the photoreceptor 1, the amount of diffuse light subtracted internally may be greater than the actual amount of diffuse light at the specular sensor $\mathbf{3}_{spec}$. This causes a "blind balance" and at high DMA the ETAC sensor will rail, i.e., hit a maximum, at a value of 1. Conversely, if the ETAC sensor is further away from the photoreceptor 1, too little diffuse light is subtracted, and the FAC hits a maximum near 0.6 DMA then curves downward. The error in the measured FAC is most evident at high DMA.

In order to correct for this error in the measured FAC, Xerox Corporation uses a software algorithm, which divides the measured FAC, mFAC by the maximum FAC value measured during a DMA sweep, SpecFACmax, according to Equation 2:

$$\textit{Spec}\text{FACmax corrected FAC}=\text{mFAC}/\textit{Spec}\text{FACmax} \quad (2)$$

FIG. 5 shows that this correction method is effective in resealing FAC values between 0 and 1, which is important for solid area DMA control. However, the diffuse channel is calibrated using the specular data, and this calibration is extremely sensitive to variations in FAC near 1. Initial estimates of the improvement in DMA accuracy expected from resealing by SpecFACmax assumed that this resealing would eliminate errors due to ETAC spacing variation. FIG. 6 shows, however, that for actual data resealing alone does not eliminate the error in DMA accuracy. Scaling decreases the maximum error, and brings the average error close to zero; but the error introduced in the mid and low patches can be greater than the original uncorrected error.

FIG. 7 shows that varying the ETAC spacing and SpecFACmax, and then measuring vacuum DMA, decreases the error, but does not eliminate DMA variation. Furthermore, FIG. 8 shows that for test data for CMYK color printing the amount of DMA variation after SpecFACmax correction is still about half the uncorrected variation.

SUMMARY

In a first embodiment of the invention a method of calculating a Fractional Area Coverage (FAC) for determining the solid developed mass per unit area (DMA) to evaluate the effectiveness of a xerographic printing process is provided, the method comprising: (a) providing a densitometer comprising: an illuminator configured to emit a beam of light at a point on a target, thereby producing a generally specular reflectance at a specular angle and generally diffuse reflectance at a diffuse angle; a specular sensor configured to detect the generally specular reflectance at the specular angle; a diffuse sensor configured to detect the generally diffuse reflectance in at the diffuse angle; and a processor configured to process the generally specular reflectance detected by the specular sensor and the generally diffuse reflectance detected by the diffuse sensor; and (b) calculating the Fractional Area Coverage (FAC) as a function of alpha (α), representing a fraction of diffuse reflectance at the specular angle, wherein alpha is calculated as a function of: a maximum measured FAC value returned from a calibration sweep through a range of DMA (SpecFACmax); a slope from the SpecFACmax to a last value in the DMA sweep (SpecSLOPE); or a combination thereof.

In a second embodiment of the invention, a computer readable media having stored computer executable instructions, wherein the computer executable instructions, when executed by a computer, directs a computer to perform a method for calculating a Fractional Area Coverage (FAC) for determining the density of toner to evaluate the effectiveness of a xerographic printing process using a densitometer comprising: (a) an illuminator configured to emit a beam of light at a point on a target, thereby producing a generally specular reflectance at a specular angle and generally diffuse reflectance at a diffuse angle; (b) a specular sensor configured to detect the generally specular reflectance at the specular angle; (c) a diffuse sensor configured to detect the generally diffuse reflectance at the diffuse angle; and (d) a processor configured to process the generally specular reflectance detected by the specular sensor and the generally diffuse reflectance detected by the diffuse sensor, is provided, the method comprising: calculating the Fractional Area Coverage (FAC) as a function of alpha (α), representing a fraction of diffuse reflectance at the specular angle, wherein alpha is calculated as a function of: a maximum measured FAC value returned from a calibration sweep through a range of DMA (SpecFACmax); a slope from the SpecFACmax to a last value in the DMA sweep (SpecSLOPE); or a combination thereof.

Other objects, features, and advantages of one or more embodiments of the present invention will seem apparent from the following detailed description, and accompanying drawings, and the appended claims.

BRIEF DESCRIPTION OF THE DRAWINGS

Embodiments of the present invention will now be disclosed, by way of example only, with reference to the accompanying schematic drawings in which corresponding reference symbols indicate corresponding parts, in which.

DETAILED DESCRIPTION

Figure 1A:
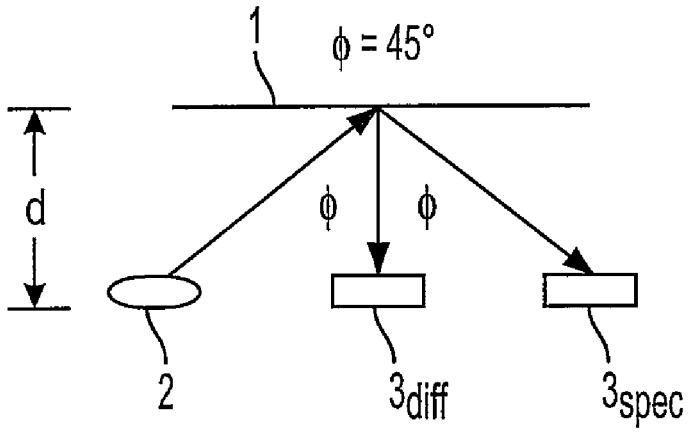
FIG. 1A and FIG. 1B show a ETAC sensor and the problems with spacing the ETAC sensor with the photoreceptor.
Figure 1B:
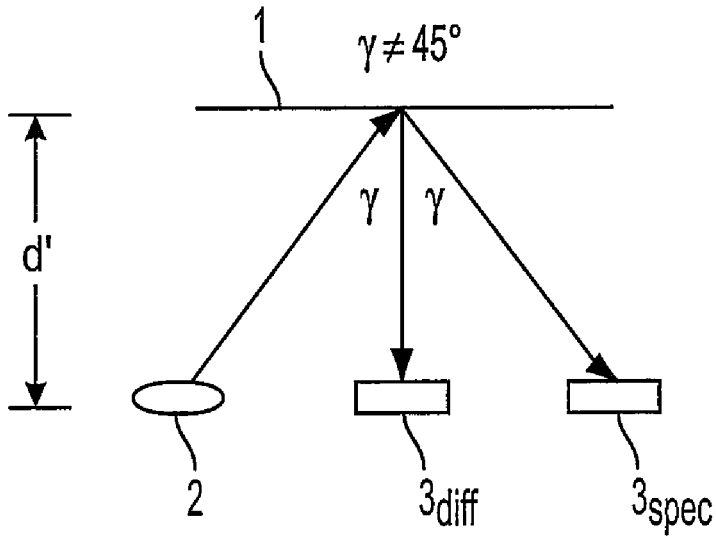
Figure 2:
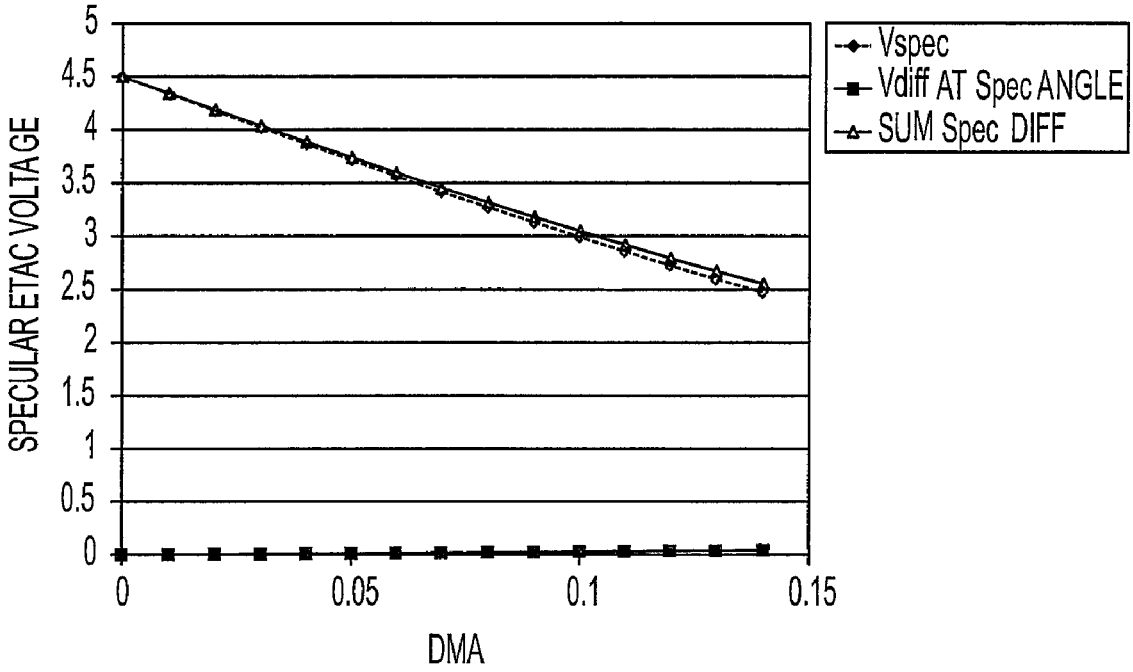
FIG. 2 shows a plot of Specular ETAC voltage vs. DMA.
Figure 3:
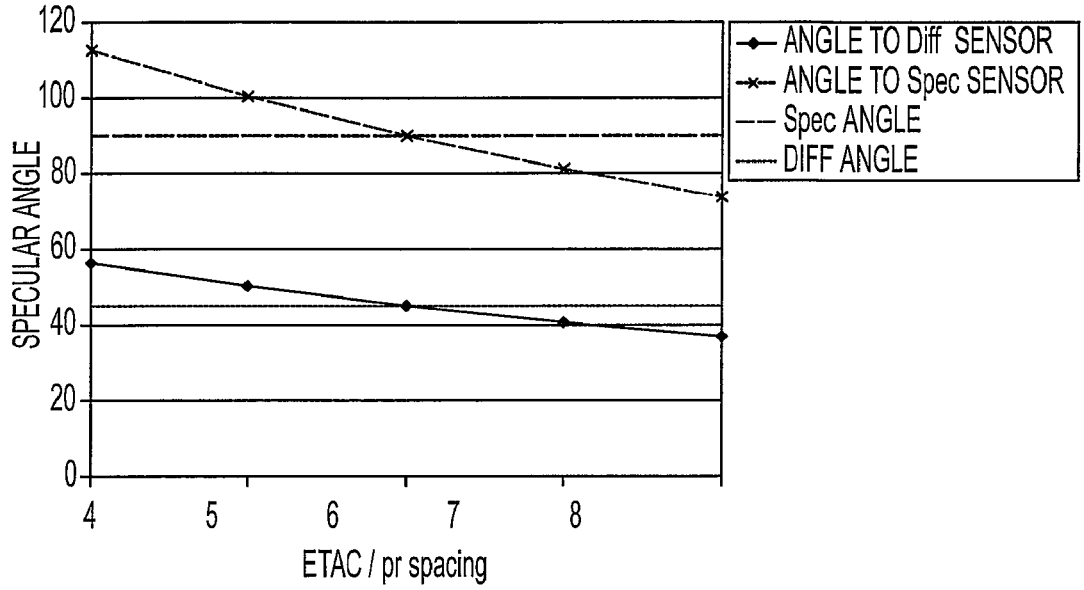
FIG. 3 shows a plot of the angles of the Specular and Diffuse sensors vs. ETAC spacing.
Figure 4:
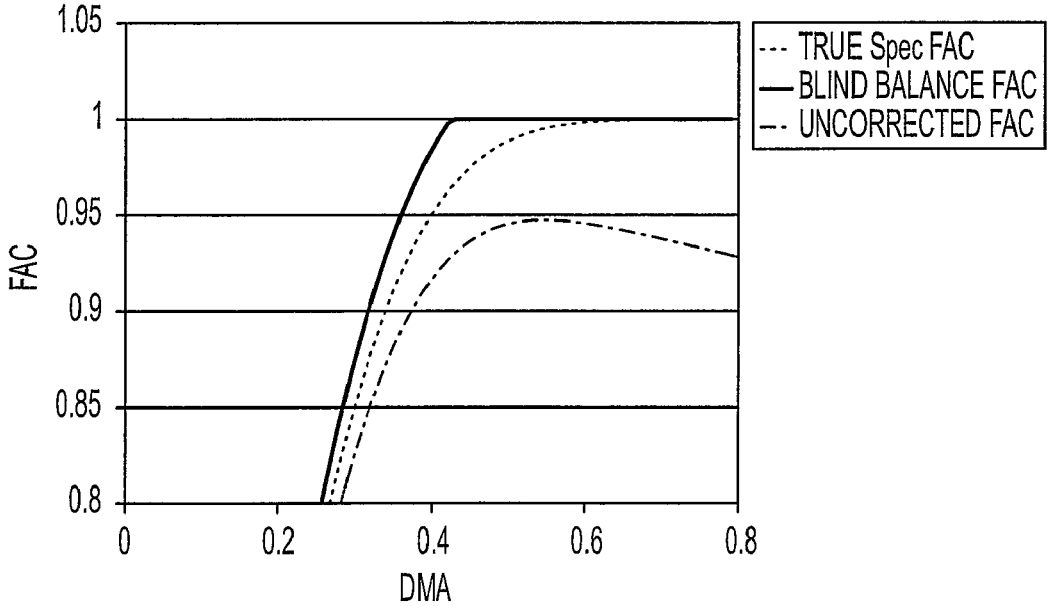
FIG. 4 shows a plot of FAC vs. DMA.
Figure 5:
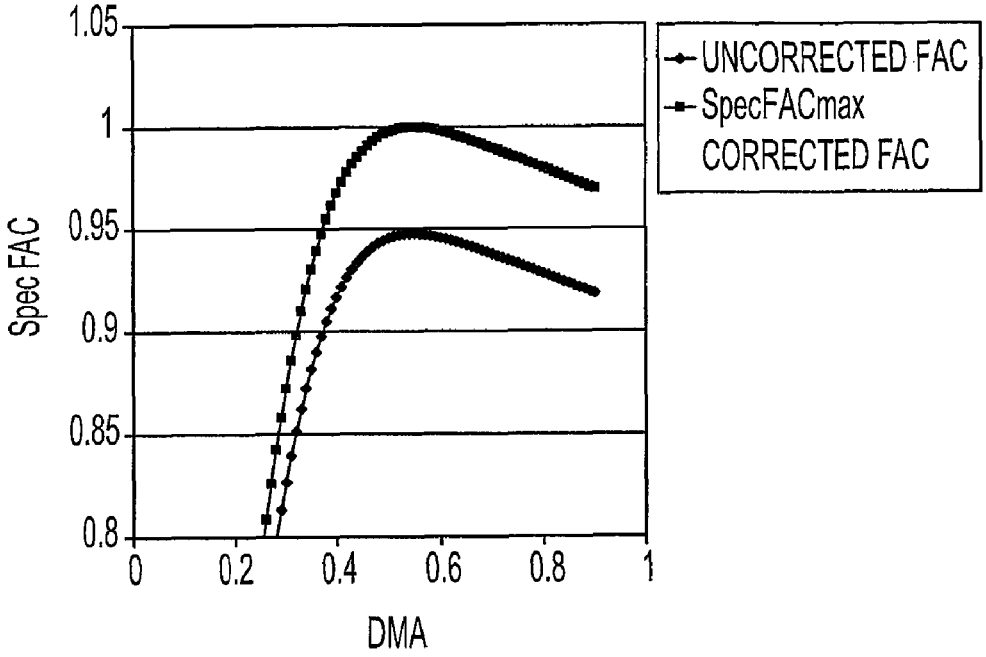
FIG. 5 shows a plot of SpecFAC vs. DMA.
Figure 6:
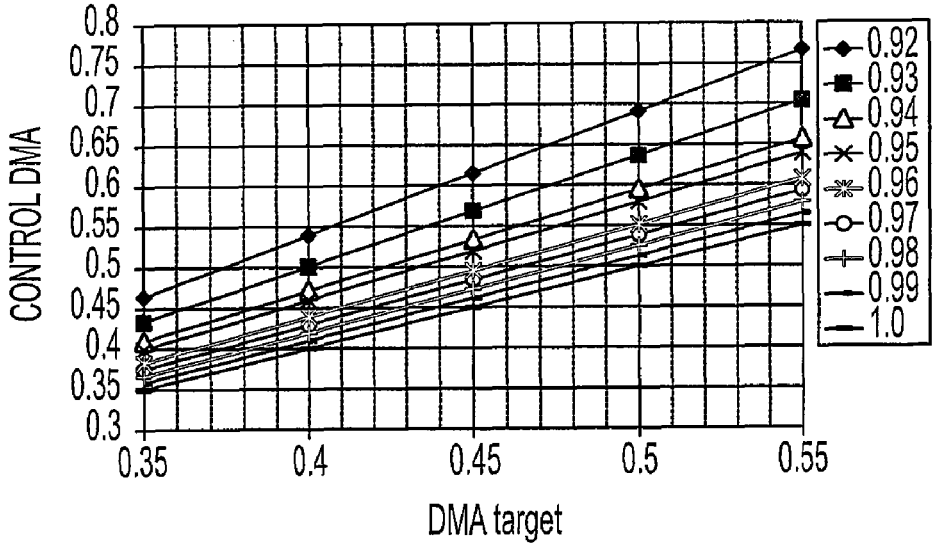
FIG. 6 shows a plot of Control DMA vs. DMA target.
Figure 7:
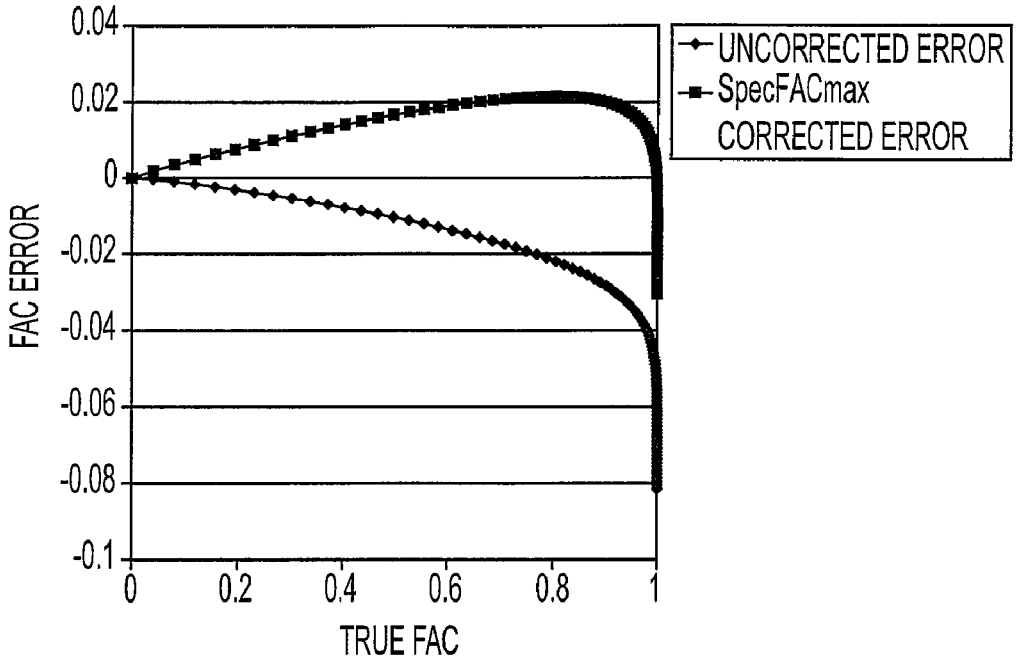
FIG. 7 shows a plot of FAC error vs. True FAC.
Figure 8:
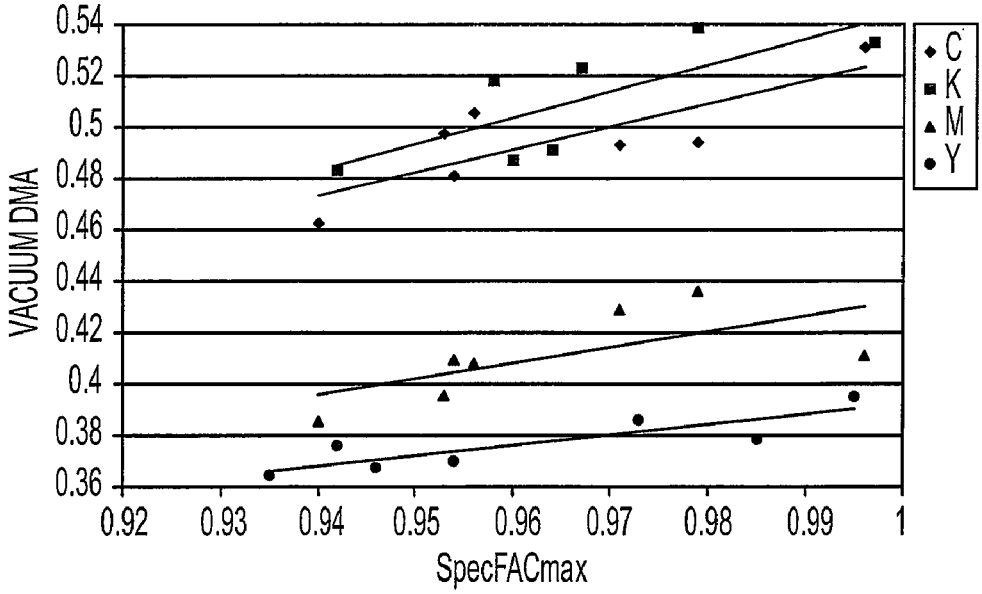
FIG. 8 shows a plot of Vacuum DMA v. SpecFACmax.

In contrast to the calibration methods discussed above, the measured specular Fractional Area Coverage, mFAC is modeled by assuming that the measured voltage from the specular sensor is actually the sum of a true specular signal and a fraction of the diffuse signal. For example, the measured specular voltage, mVspec will be modeled by taking into account the true impact of the measured voltage of the diffuse sensor, according to Equation 3:

$$mVspec=Vspec+\alpha*Vdiff \tag{3}$$

where: mVspec is the measured voltage returned by the specular sensor;

Vspec is the true sensor voltage, which would have been returned to the specular sensor, if the toner did not scatter incident light (i.e., having no diffuse light reflectance);

alpha, $\alpha$ represents the fraction of diffuse light actually reflected at the specular angle for the current ETAC sensor (less the fraction of the diffuse sensor signal that may be internally subtracted by the ETAC sensor); and Vdiff is the measured voltage returned by the diffuse sensor.

Black toner absorbs practically all the light at the wavelength of the LED. Thus, for black toner, alpha is approximately zero; and mVspec substantially equals Vspec. However, colored toner does not absorb all of the light, and scatters a substantial amount of light over a range of angles. Some of this scattered light gets measured by the specular sensor, and increases mVspec. Thus, for colored toner, alpha may have a substantial impact on the FAC calculation.

The measured FAC calculation, mFAC is shown in Equation 4:

$$mFAC=(Vcb-mVspec)/(Vcb-V01x) \tag{4}$$

Equation 4 is a modification of Equation 1 using mVspec instead of Vspec. Substituting Equation 3 for mVspec into Equation 4, and then substituting FAC for the terms equal to FAC from Equation 1, yields Equation 5:

$$mFAC=FAC-\alpha*Vdiff/(Vcb-V01x) \tag{5}$$

where: FAC is the true area of the photoreceptor covered by toner.

The goal of the calibration is to determine FAC as precisely as possible using measured values. Thus, solving Equation 5 for the true FAC yields Equation 6:

$$FAC=mFAC+(\alpha*Vdiff)/(Vcb-V01x) \tag{6}$$

Unfortunately, the value of alpha is not known. However, the maximum specular value FAC, SpecFACmax and the specular slope, SpecSLOPE, both of which are determined during the DMA curve calibration "sweep," are two variables that are both influenced by alpha. SpecFACmax is defined as the maximum measured FAC value returned on sweeping through a range of DMA. SpecSLOPE is defined as the slope from this maximum value to the last (highest DMA) value in the sweep.

Xerox Corporation currently includes a specular calibration phase diagnostic program with its ETAC sensor, which provides measurements for FAC according to Equation 1, as well as determines both SpecFACmax and SpecSLOPE. Thus, by determining the relationships between these measured values using a model, alpha can be determined. The model may be a polynomial equation, regression line, or other known data-fitting technique ("best fit") for correlating data.

Figure 9:
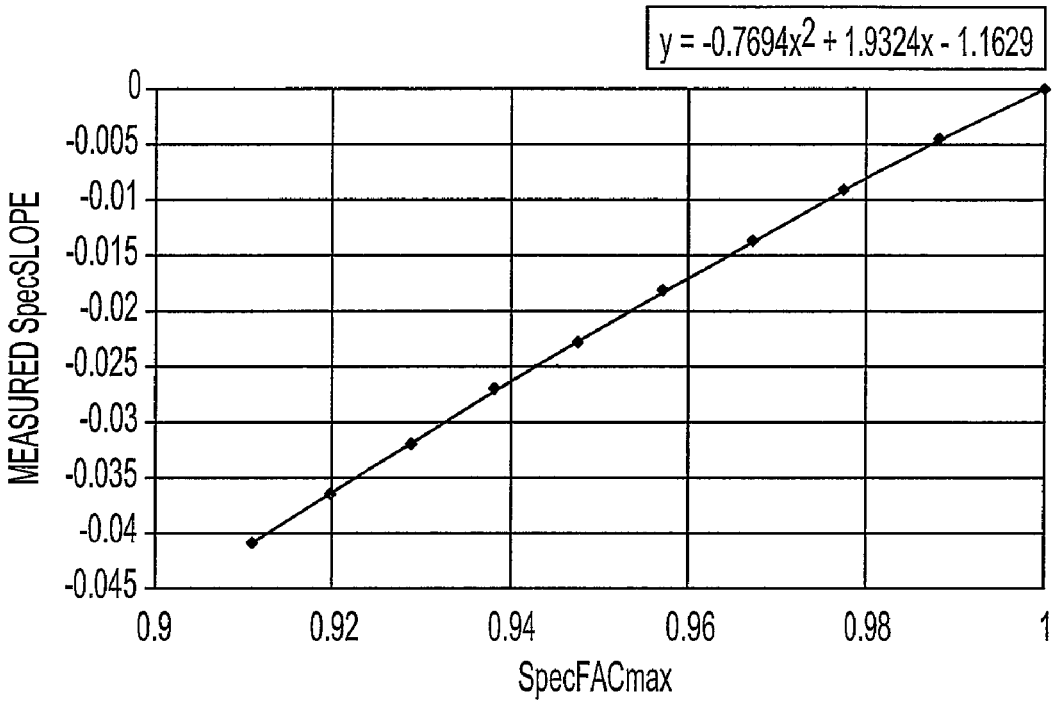
FIG. 9 shows a plot of a model correlating the Measured SpecSLOPE values with SpecFACmax values, in accordance with an embodiment of the invention
Figure 14:
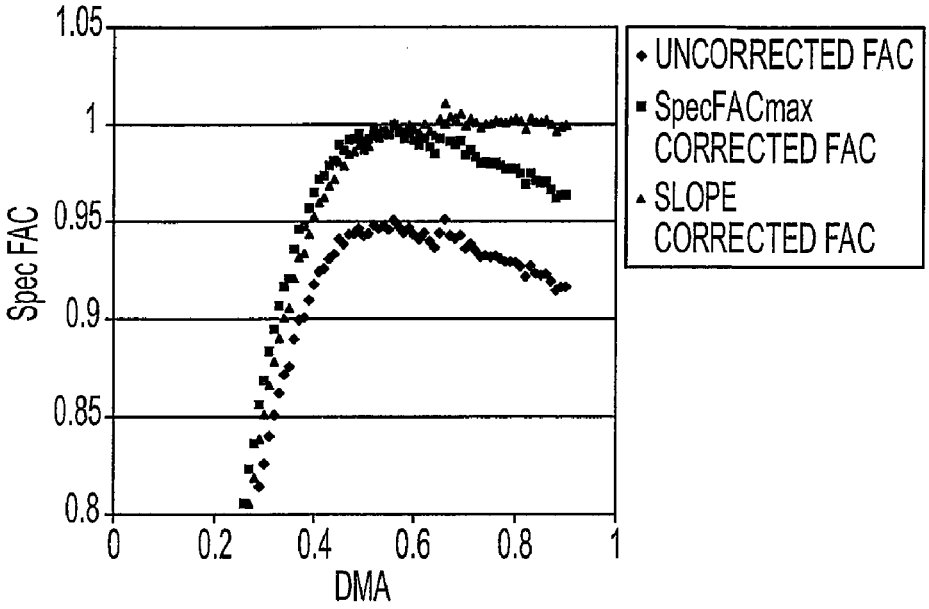
FIG. 14 shows a plot of SpecFAC vs. DMA for uncorrected, SpecFACmax division and balance corrected data.

FIG. 9 shows a plot of a model correlating SpecSLOPE and SpecFACmax. A plurality of alpha values were initially selected, as well as other ETAC sensor parameters (e.g., noise, response time, sensitivity, etc.). For each of the alpha values, corresponding FAC values were calculated using Equation 6 over the DMA sweep (similar to the plotted values as shown in FIG. 14.) Next, SpecSLOPE and SpecFACmax values for the DMA sweep were provided from the calibration specular calibration phase diagnostic program. A model was determined by performing a best fit analysis. In this particular embodiment, a model of a quadratic equation was used.

Figure 10:
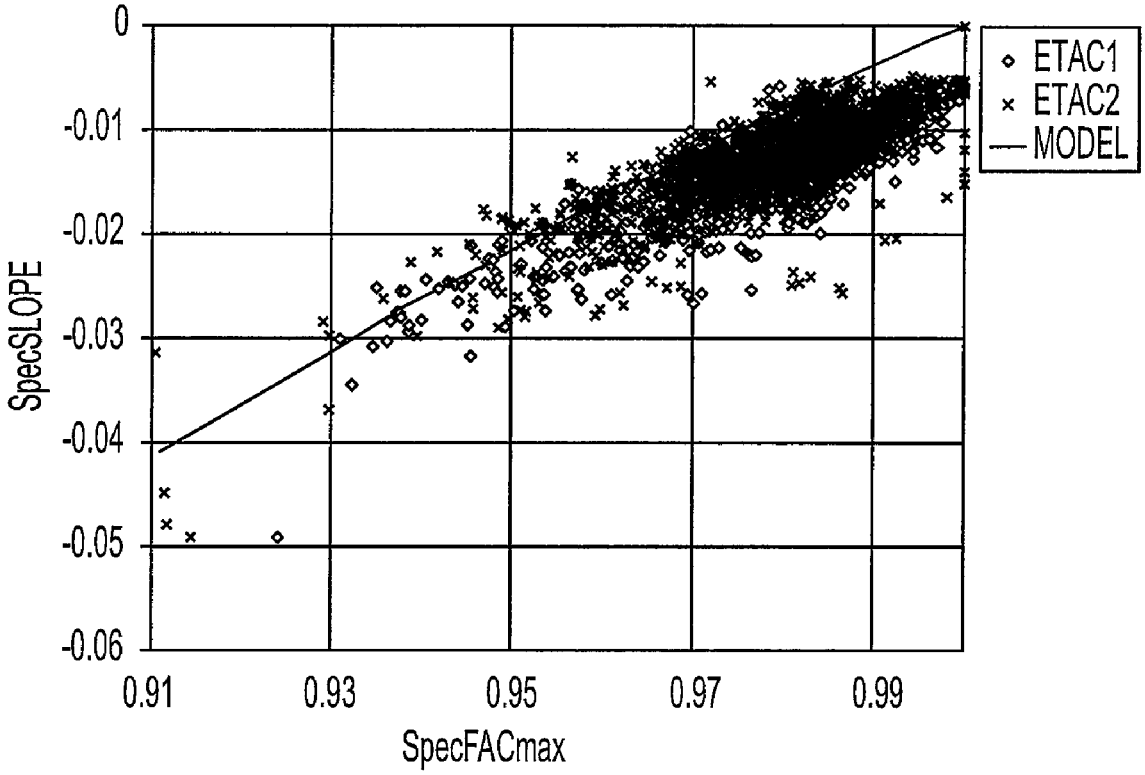
FIG. 10 shows a plot of fleet data for the Measured SpecSLOPE values and SpecFACmax values and the model of FIG. 9.

FIG. 10 shows actual data from two ETAC sensors, ETAC1 and ETAC2 that was plotted according to the measured values for SpecFACmax and SpecSLOPE. As predicted by the model shown in FIG. 9, there is a reasonably tight correlation between SpecFACmax and SpecSLOPE. However, the data does not correlate equally around the model line, especially at SpecFACmax values close to 1, where the measured SpecSLOPE is less than, i.e., more negative than, the model would project.

Figure 11:
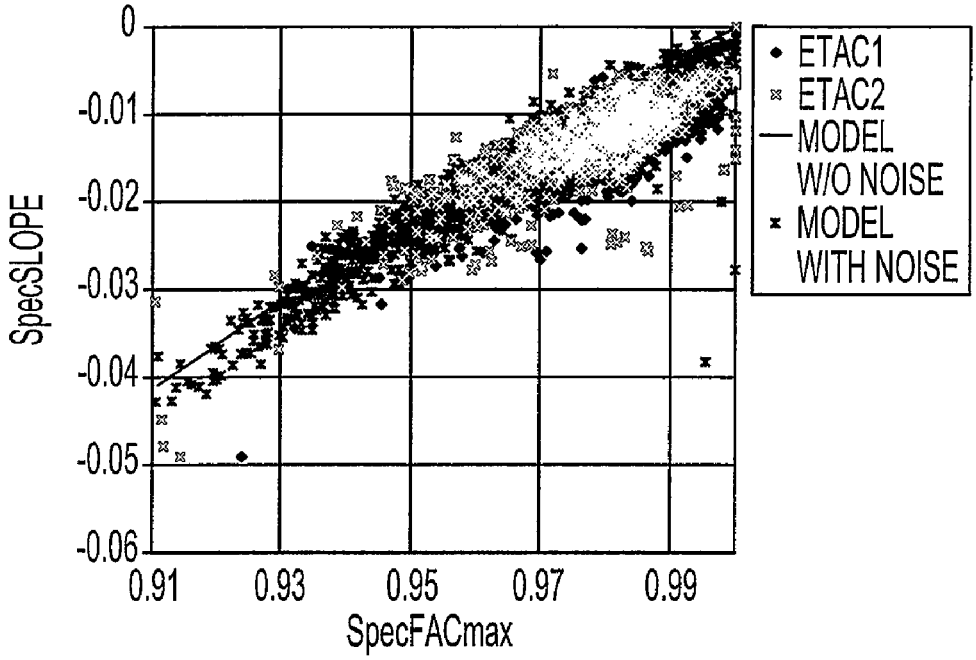
FIG. 11 shows a plot of fleet data for the Measured SpecSLOPE values and SpecFACmax values and the model of FIG. 9, with and without noise added.

A simulation was created which emulated Xerox Corporation's procedure for determining SpecFACmax and SpecS- LOPE values. FIG. 11 shows that when noise was intentionally added to the ETAC specular and diffuse readings, the resulting data yielded a plot, which looked similar to the data plotted in FIG. 10. As with the actual data for ETAC1, ETAC2, there were some points in the model generated with noise, which deviated from the model.

Figure 12:
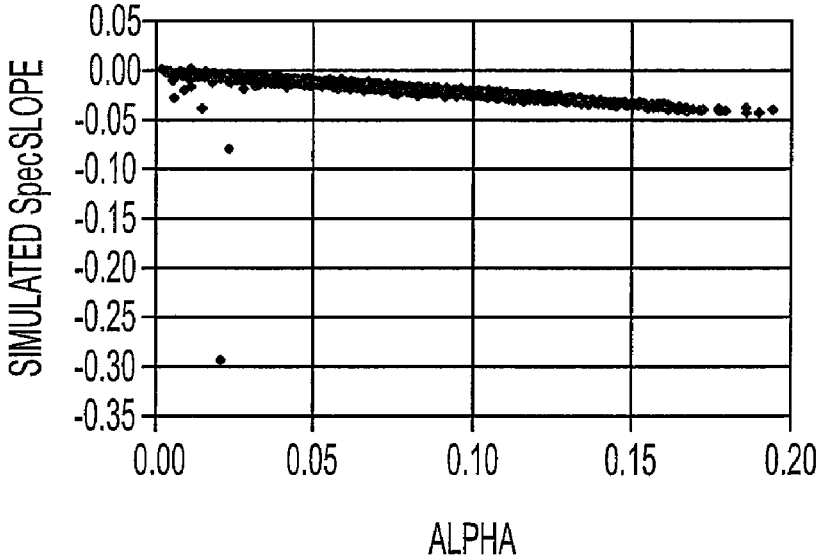
FIG. 12 shows a plot of a model correlating simulated SpecSLOPE values with alpha, the amount of diffuse light which must be subtracted to correct the diffuse balance error, in accordance with an embodiment of the invention.
Figure 13:
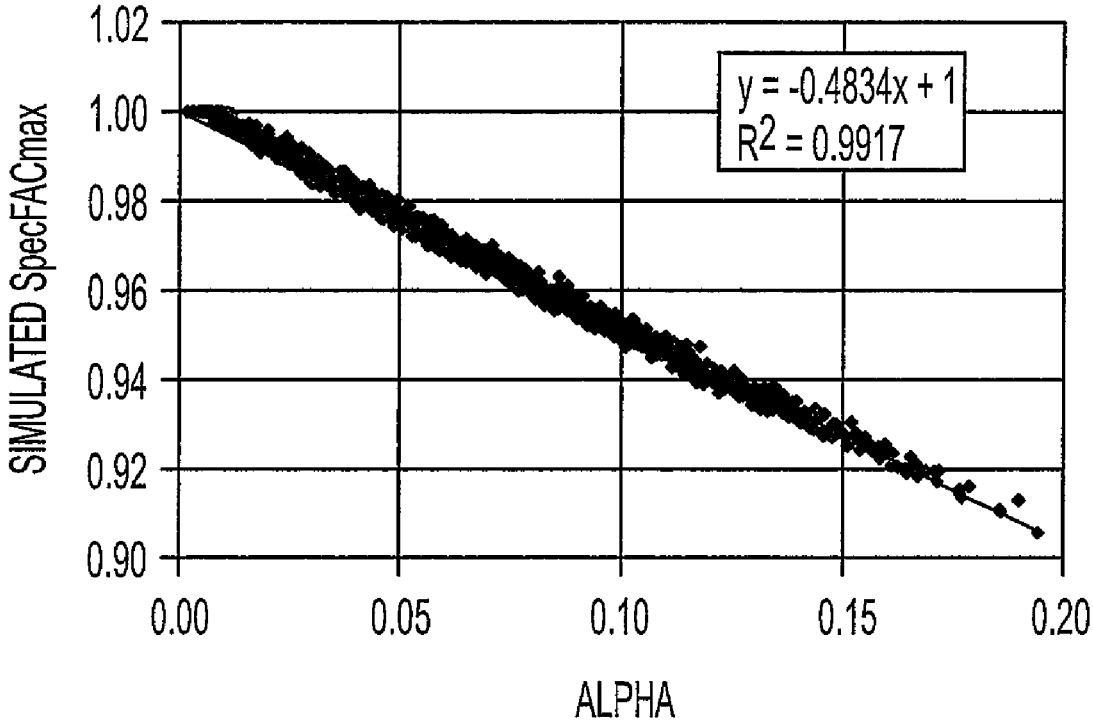
FIG. 13 shows a plot of a model correlating simulated SpecFACmax values with alpha, in accordance with an embodiment of the invention.

FIG. 12 shows a plot of a model correlating alpha and simulated SpecSLOPE values. FIG. 13 shows a plot of a model correlating alpha and simulated SpecFACmax values. In both of these models, a plurality of alpha values were initially selected, as well as other ETAC sensor parameters (e.g., noise, response time, sensitivity, etc.). For each of the alpha values, true FAC values were calculated using Equation 6 over the DMA sweep (similar to the plotted values shown in FIG. 14). Next, SpecSLOPE and SpecFACmax values for each DMA sweep were provided from the specular calibration phase diagnostic program.

FIG. 12 shows that while most of the values for the simulated SpecSLOPE values are well correlated to alpha, there are a few points with alpha values less than 0.03, which appear erroneous. FIG. 13, on the other hand, shows a clearly linear relationship between alpha and the simulated SpecFACmax values.

Further investigation found this to be due to the SpecSLOPE measurement technique. While SpecFACmax is the maximum FAC value returned on sweeping through a range of DMA, SpecSLOPE is the slope from this maximum value to the last (highest DMA) value in the sweep. When alpha is close to 0 (i.e., when the actual diffuse correction required is close to the internal diffuse correction being applied), the slope at high DMA is close to zero, and SpecFACmax is close to 1. However, under these conditions, random measurement noise may cause the maximum FAC value to be very close to the end of the sweep, and may in fact be the next to the last point. As such, measurement noise may then give a local slope between the last two points in the sweep which is much greater than the actual, near zero, slope.

Moreover, even though SpecFACmax is a point measurement, and SpecSLOPE is a regression fit through multiple points, the SpecFACmax values are far more robust to noise. Thus, by determining the equation for the regression line model for the data in FIG. 13, alpha may be correlated with SpecFACmax. For the particular regression line of the data correlating the SpecFACmax to alpha in FIG. 13, the regression line is defined by Equation 7:

$$y=0.4834*x+1 \tag{7}$$

Solving for x in Equation 7, yields Equations 8 for determining alpha:

$$\alpha=(1-Spec\mathrm{FACmax})/\beta \tag{8}$$

where: beta, $\beta$ is the slope of the regression line correlating alpha and the measured SpecFACmax.

For the particular plot of the data in FIG. 13, beta is approximately equal to 0.48. Thus, substituting 0.48 for beta into Equation 8, yields Equation 8A.

$$\alpha=(1-Spec\mathrm{FACmax})/0.48 \tag{8A}$$

Thus, according to this model the measured FAC values (using Equation 5) may be corrected by calculating alpha using the Equations 6 and 8A.

Simulation of this correction has shown promising results, as shown in FIG. 14; although noise leads to some FAC points greater than 1. However, since the diffuse to specular calibration used in setting up the solid area DMA only uses points with FAC values less than 0.95, this is not a concern.

Correcting the specular FAC using alpha and the measured diffuse voltage is also expected to improve control of the tone reproduction curve far from the solid. For example, in a simulation the above model was used to generate 1,000 Specular calibration curves with noise (in both specular and diffuse voltages), and calculated the error at the low and mid points of the TRC due to correcting the specular reads using measured Vdiff and calculated alpha, for a reasonable amount of ETAC noise.

Figure 15:
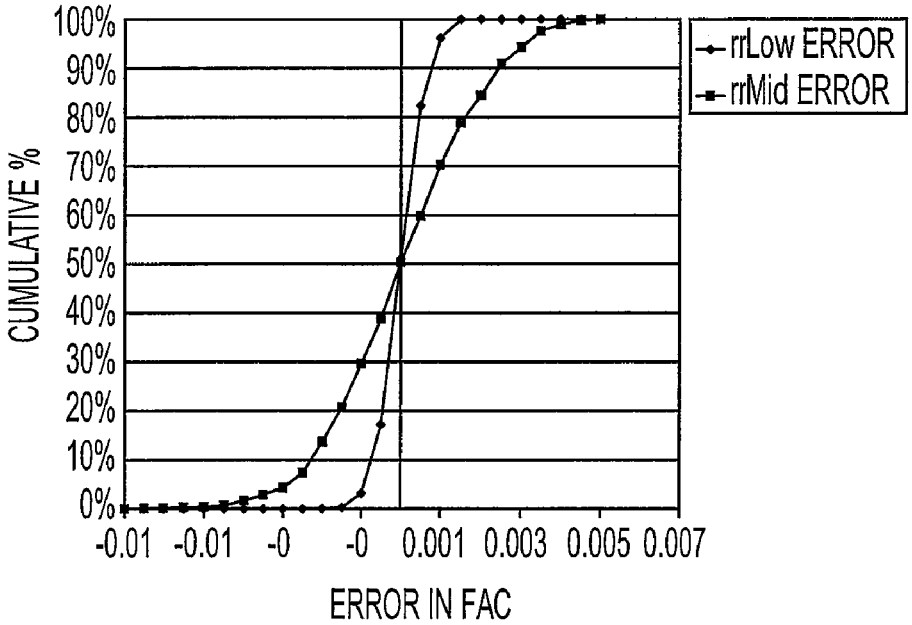
FIG. 15 shows a plot of Cumulative % vs. Error in FAC.

FIG. 15 shows that the error in the mid range of FAC, rrMid ranged from −0.007 to 0.005. The error in the low range of FAC, rrLow is even lower, ranging from −0.002 to 0.0015. These errors are less than a quarter of the current projected error in FAC.

Ideally, alpha may be stored in non-volatile memory, however, this is not necessary, since it may now be easily calculated from SpecFACmax values according to Equation 8.

This model suggests that it would be advantageous to correct the measured FAC using Equations 6 and 8. Further, the model more accurately approximates the impact of diffuse-balance errors throughout the tone reduction curve.

Implementation Test

During the implementation test using Equations 6 and 8A, two ETAC sensors, ETAC1 and ETAC2, each having different internal diffuse balance characteristics were used, where:

For the first ETAC sensor, SpecFACmax1=0.924.

For the second ETAC sensor, SpecFACmax2=0.965.

Figure 16:
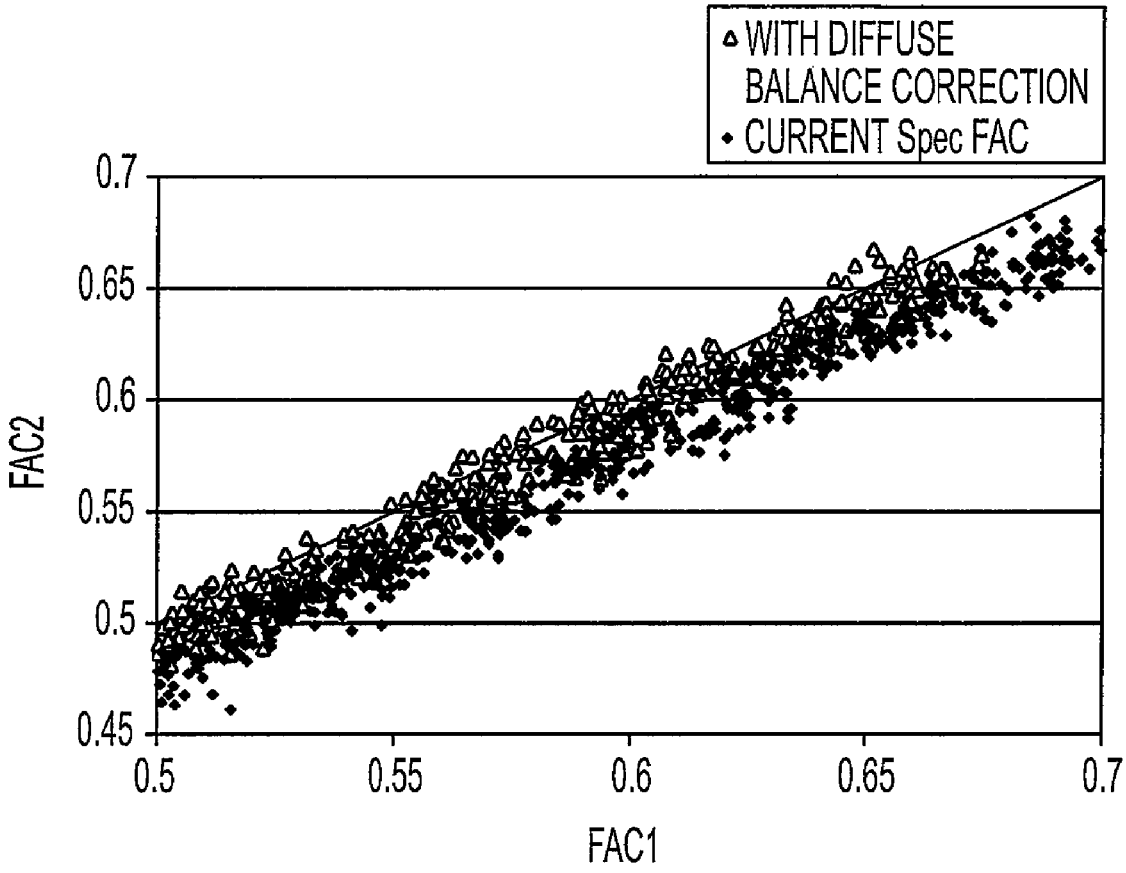
FIG. 16 shows a comparison of the FAC returned by two ETAC sensors ETAC1, ETAC2 with and without the diffuse balance correction.

A diagnostic test was performed to calculate Vcb, SpecFACmax and V01x. FIG. 16 shows a comparison of the FAC values returned by two ETAC sensors ETAC1, ETAC2 with and without diffuse balance correction. The output from ETAC2 is shown on the y-axis, against the output from ETAC1 on the x-axis. SpecFAC and Diffuse reads were taken over a wide range of digital area coverages, Raster Optical Scanner/Print engine cleaning fields (ROS/Vmc). The plot shows a subset of the data near a mid range of FAC, rrMid.

With the current SpecFACmax correction there is a clear difference between the FACs returned by the different ETAC sensors when reading the same patch. Yet, this difference is essentially eliminated with the diffuse balance correction model of the present invention.

Advantageously, the above calibration equations were derived by taking into account the value of diffuse light internally subtracted from the specular sensor signal by the ETAC sensor, for example, as disclosed in U.S. Pat. No. 5,162,874, mentioned above. Thus, the calibration procedure may be implemented on existing ETAC sensors and densitometers which currently use internal diffuse subtraction for correcting mVspec. Indeed, Equation 6 determines the true FAC values based on measured FAC values returned from Xerox's existing specular calibration phase diagnostic program.

In addition, the calibration procedure may also be implemented with ETAC sensors and densitometers using the measured specular and diffuse sensor signals alone. Since there will be no diffuse light signal that is internally subtracted by the ETAC sensor, alpha will simply represent the fraction of diffuse light actually reflected at the specular angle for the current ETAC sensor. Using one of the models disclosed above, alpha may be easily determined.

Next, the true sensor voltage Vspec', which would have been returned to the specular sensor, if the toner did not scatter incident light (i.e., having no diffuse light reflectance) may be determined by solving Equation 3, which yields Equation 9.

$$Vspec'=mVspec-\alpha*Vdiff \tag{9}$$

Once Vspec' is determined, the true FAC may then be determined, using a modified version of Equation 1, according to Equation 10:

$$FAC=(Vcb-Vspec')/(Vcb-V01x) \quad (10)$$

The invention may also have applicability for use with linear illuminators (e.g., linear LED arrays, or lamps) and linear specular and diffuse sensors, (e.g., a full width array (FWA) sensor, contact image sensors or CCD array sensors), as disclosed, for example, in U.S. patent application Ser. No. 11/783,174, filed Apr. 6, 2007, entitled "Gloss And Differential Gloss Measuring System," and herein incorporated by reference.

It will be appreciated to those skilled in the art that a different measurement procedure for SpecSLOPE, rather than the SpecFACmax described herein and previously implemented may yield a more accurate model, which would be useful for determining alpha. Furthermore, it may also possible to calculate alpha using both SpecFACmax and SpecSLOPE, and do a weighted average of the two measurements in order to improve accuracy. This invention, therefore, is intended to cover correcting the diffuse balance based on an accurate measurement of SpecFACmax, SpecSLOPE, or a combination thereof.

While the specific embodiments of the present invention have been described above, it will be appreciated that the invention may be practiced otherwise than described. The description is not intended to limit the invention.

What is claimed is:

1. A method of calculating a Fractional Area Coverage (FAC) for determining the solid developed mass per unit area (DMA) to evaluate the effectiveness of a xerographic printing process, the method comprising:

(a) measuring a plurality of test patterns having varying predetermined toner or ink densities formed thereon using a sensing system, the sensing system comprising:
- an illuminator configured to emit a beam of light at a point on a target, thereby producing a generally specular reflectance at a specular angle and generally diffuse reflectance at a diffuse angle;
- a specular sensor configured to detect the generally specular reflectance at the specular angle;
- a diffuse sensor configured to detect the generally diffuse reflectance at the diffuse angle; and
- a processor configured to process the generally specular reflectance detected by the specular sensor and the generally diffuse reflectance detected by the diffuse sensor;

(b) for each of the test patterns measured, calculating a measured FAC value (mFAC) from the specular and diffuse sensor readings for that test pattern;

(c) calculating the true Fractional Area Coverage (FAC) for each measured test pattern as a function of alpha ($\alpha$), representing a fraction of diffuse reflectance at the specular angle, wherein alpha is calculated as a function of:
- (i) a maximum mFAC value determined from the measurements of the test patterns (SpecFACmax); or
- (ii) a slope measured from the maximum mFAC value to the mFAC value corresponding to a highest DMA value in a sweep (SpecSLOPE).

2. The method according to claim 1, wherein alpha is the difference between the fraction of diffuse reflectance at the specular angle and the fraction of the diffuse sensor signal that is internally subtracted from the specular sensor signal by the processor.

3. The method according to claim 2, wherein the fraction of the diffuse sensor signal that is internally subtracted from the specular sensor signal by the sensor is the ratio of the voltages of the specular and diffuse sensor signals when presented with the target.

4. The method according to claim 1, wherein the true FAC is calculated, according to the following equation:

$$FAC=mFAC+(\alpha*Vdiff)/(Vcb-V01x),$$

where: Vdiff is the measured voltage returned by the diffuse sensor;

Vcb is the voltage returned from the specular sensor from a clean photoreceptor; and V01x is the background noise signal returned from the specular sensor with the illuminator turned off.

5. The method according to claim 4, wherein the mFAC is calculated, according to the following equation:

$$mFAC=(Vcb-mVspec)/(Vcb-V01x),$$

where: mVspec is the measured voltage returned by the specular sensor (less any internal diffuse subtraction by the sensing system).

6. The method according to claim 1, wherein alpha is calculated, according to the following equation:

$$\alpha=(1-Spec\text{FACmax})/\beta$$

where: beta ($\beta$) is a constant derived from a slope of a regression line correlating alpha and SpecFACmax.

7. The method according to claim 6, wherein beta is approximately 0.48.

8. The method according to claim 1, wherein alpha is a function of a best fit equation correlating alpha and the SpecSLOPE.

9. The method according to claim 1, wherein alpha is a function of the weighted averages of the SpecFACmax and the SpecSLOPE measurements.

10. The method according to claim 1, wherein alpha is a function of the best fit equation correlating the SpecFACmax and the SpecSLOPE measurements.

11. The method according to claim 1, wherein mFAC, SpecFACmax, and SpecSLOPE are determined by a calibration procedure.

12. The method according to claim 1, wherein the illuminator is located at approximately a 45° angle with respect to the diffuse sensor and at approximately a 90° angle with respect to the specular sensor.

13. The method according to claim 1, wherein the illuminator is one of an LED, a linear LED array or a lamp.

14. The method according to claim 1, wherein the specular and diffuse sensors are linear array sensors.

15. The method according to claim 1, wherein the sensing system is an Enhanced Tone Area Coverage (ETAC) sensor.

16. The method according to claim 1, wherein the specular sensor voltage (Vspec) which would have been returned to the specular sensor if the toner completely absorbed all incident light is calculated, according to the following equation:

$$Vspec=mVspec-\alpha*Vdiff,$$

where: mVspec is the measured voltage returned by the specular sensor; and

Vdiff is the measured voltage returned by the diffuse sensor.

17. A non-transitory computer readable media having stored computer executable instructions, wherein the computer executable instructions, when executed by a computer, directs a computer to perform a method for calculating a Fractional Area Coverage (FAC) for determining the density of toner to evaluate the effectiveness of a xerographic printing process using a sensing system comprising: (a) an illuminator configured to emit a beam of light at a point on a target, thereby producing a generally specular reflectance at a specular angle and generally diffuse reflectance at a diffuse angle; (b) a specular sensor configured to detect the generally specular reflectance at the specular angle; (c) a diffuse sensor configured to detect the generally diffuse reflectance at the diffuse angle; and (d) a processor configured to process the generally specular reflectance detected by the specular sensor and the generally diffuse reflectance detected by the diffuse sensor; the method comprising:

(a) receiving measurements for a plurality of test patterns having different predetermined toner or ink densities formed thereon from the sensing system, (b) for each of the test pattern measurements, calculating a measured FAC value (mFAC) from the specular and diffuse sensor readings for that test pattern;

(c) calculating the true Fractional Area Coverage (FAC) for each measured test pattern as a function of alpha ($\alpha$), representing a fraction of diffuse reflectance at the specular angle for each measurement, wherein alpha is calculated as a function of:

(i) a maximum mFAC value determined from the measurements of the test patterns (SpecFACmax); or (ii) a slope measured from the maximum mFAC value to the mFAC value corresponding to a highest DMA value in a sweep (SpecSLOPE).

18. The computer readable media according to claim 17, wherein alpha is the difference between the fraction of diffuse reflectance at the specular angle and the fraction of the diffuse sensor signal that is internally subtracted from the specular sensor signal by the processor.

19. The computer readable media according to claim 18, wherein the fraction of the diffuse sensor signal that is internally subtracted from the specular sensor signal by the sensing system is the ratio of the voltages of the specular and diffuse sensor signals when presented with the target.

20. The computer readable media according to claim 17, wherein the true FAC is calculated, according to the following equation:

$$FAC=mFAC+(\alpha*Vdiff)/(Vcb-V01x),$$

where: Vdiff is the measured voltage returned by the diffuse sensor;

Vcb is the voltage returned from the specular sensor from a clean photoreceptor; and V01x is the background noise signal returned from the specular sensor with the illuminator turned off.

21. The computer readable media according to claim 20, wherein the mFAC is calculated, according to the following equation:

$$mFAC=(Vcb-mVspec)/(Vcb-V01x),$$

where: mVspec is the measured voltage returned by the specular sensor (less any internal diffuse subtraction by the sensing system).

22. The computer readable media according to claim 17, wherein alpha is calculated, according to the following equation:

$$\alpha=(1-SpecFACmax)/0$$

where: beta ($\beta$) is a constant derived from a slope of a regression line correlating alpha and SpecFACmax.

23. The computer readable media according to claim 22, wherein beta is approximately 0.48.

24. The computer readable media according to claim 17, wherein alpha is a function of a best fit equation correlating alpha and the SpecSLOPE.

25. The computer readable media according to claim 17, wherein alpha is a function of the weighted averages of the SpecFACmax and the SpecSLOPE measurements.

26. The computer readable media according to claim 17, wherein alpha is a function of the best fit equation correlating the SpecFACmax and the SpecSLOPE measurements.

27. The computer readable media according to claim 17, wherein mFAC, SpecFACmax, and SpecSLOPE are determined by a calibration procedure.

28. The method according to claim 1, wherein SpecSLOPE is a regression fit through multiple points.

* * * * *